US007664279B2

(12) United States Patent
Flynn et al.

(10) Patent No.: US 7,664,279 B2
(45) Date of Patent: Feb. 16, 2010

(54) EQUIPMENT FOR FITTING A HEARING AID TO THE SPECIFIC NEEDS OF A HEARING IMPAIRED INDIVIDUAL AND SOFTWARE FOR USE IN A FITTING EQUIPMENT FOR FITTING A HEARING AID

(75) Inventors: Mark Flynn, Smorum (DK); Jes Olsen, Smorum (DK)

(73) Assignee: Oticon A/S, Smorum (DK)

( * ) Notice: Subject to any disclaimer, the term of this patent is extended or adjusted under 35 U.S.C. 154(b) by 237 days.

(21) Appl. No.: 10/591,900

(22) PCT Filed: Mar. 9, 2005

(86) PCT No.: PCT/EP2005/051041

§ 371 (c)(1),
(2), (4) Date: Sep. 7, 2006

(87) PCT Pub. No.: WO2005/086537

PCT Pub. Date: Sep. 15, 2005

(65) Prior Publication Data

US 2007/0172088 A1 Jul. 26, 2007

(30) Foreign Application Priority Data

Mar. 10, 2004 (DK) ..... 2004 00394

(51) Int. Cl.
*H04R 25/00* (2006.01)

(52) U.S. Cl. ..... 381/314; 381/60; 381/312

(58) Field of Classification Search ..... 381/60, 381/312, 314, 315, 320, 321, 323; 73/585; 600/559

See application file for complete search history.

(56) References Cited

U.S. PATENT DOCUMENTS

| | | | | |
|---|---|---|---|---|
| 4,901,353 | A | 2/1990 | Widin | |
| 6,175,635 | B1 | 1/2001 | Meyer et al. | |
| 6,201,875 | B1 * | 3/2001 | Davis et al. | 381/60 |
| 6,574,340 | B1 | 6/2003 | Bindner et al. | |
| 7,321,662 | B2 * | 1/2008 | Lundh et al. | 381/314 |
| 2004/0071304 | A1 | 4/2004 | Yanz et al. | |

FOREIGN PATENT DOCUMENTS

| | | | |
|---|---|---|---|
| EP | 1 351 552 | A2 | 10/2003 |
| EP | 1 359 787 | A2 | 11/2003 |
| WO | WO-03/003792 | A1 | 1/2003 |

* cited by examiner

*Primary Examiner*—Huyen D Le
(74) *Attorney, Agent, or Firm*—Birch, Stewart, Kolasch & Birch, LLP

(57) ABSTRACT

The invention relates to equipment for fitting a hearing aid to the specific needs of a hearing impaired individual. The equipment comprising a computer or similar device with soft-ware, where the device has display means for visual display of data, data entry means for entering hearing aid programming data into the device, data storing means, and data output means for outputting programming data to the hearing aid. According to the invention means are provided for selecting simultaneous settings relating to two or more different parameters relating to the processing of sound in the hearing aid to be programmed.

11 Claims, 1 Drawing Sheet

1: computing device, 2 : software, 3: display unit, 4: Data intake unit, 5: Data storage unit, 6: hearing aid data output unit, 7: parameter selector, 8: control indicator.

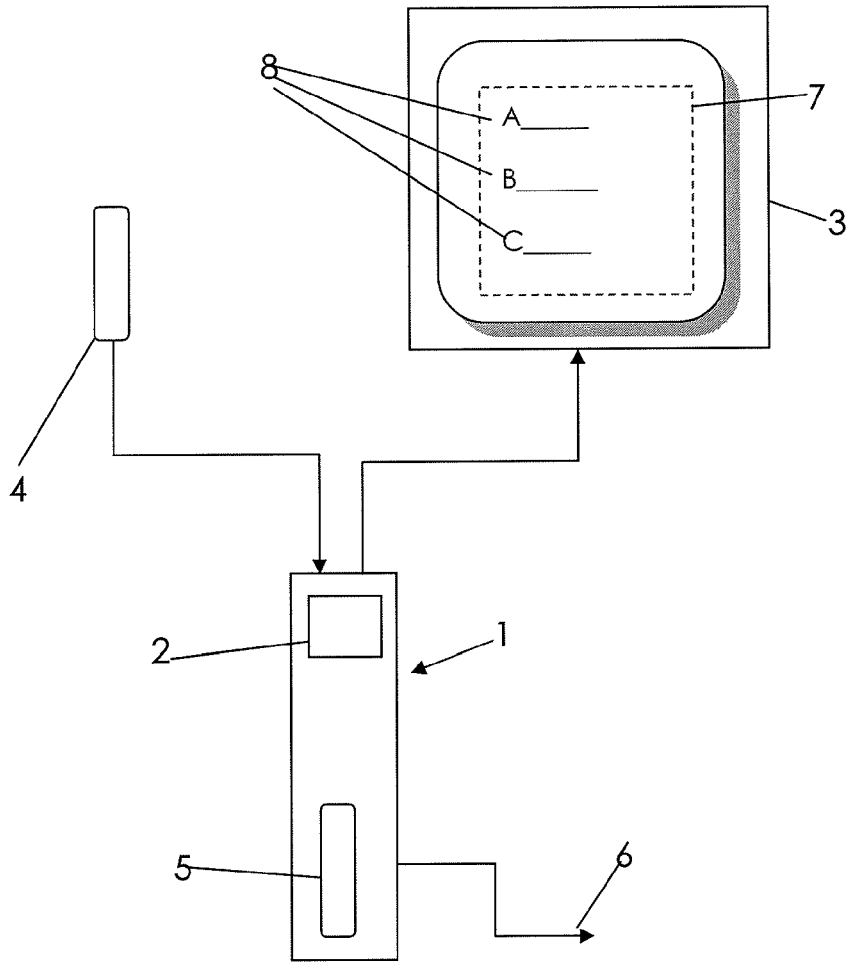
1: computing device, 2 : software, 3: display unit, 4: Data intake unit, 5: Data storage unit, 6: hearing aid data output unit, 7: parameter selector, 8: control indicator.

EQUIPMENT FOR FITTING A HEARING AID TO THE SPECIFIC NEEDS OF A HEARING IMPAIRED INDIVIDUAL AND SOFTWARE FOR USE IN A FITTING EQUIPMENT FOR FITTING A HEARING AID

AREA OF THE INVENTION

The invention relates to the area of hearing aid fitting. More particularly the invention relates to the area of equipment for fitting hearing aid to the specific needs of hearing impaired individuals. Such equipment usually comprise a computer with a computer-program or similar device, where the device has display means for visual display of data, data entry means for entering data into the device, data storing means, computation means for combining the input data, and data output means for outputting programming data to the hearing aid.

BACKGROUND OF THE INVENTION

Most modern hearing aids are programmable for adaptation to the hearing aid users needs. Rationales have been developed, which provides a good first approach to the fitting of the hearing aid to the user. The rationales are data sets specifying the transfer function or the gain of the hearing aid over a relevant frequency area.

When a hearing-impaired person seeks help in the form of a hearing aid, a process of evaluation, prescription, initial fitting and subsequent fine-tuning takes place, at the end of which it is hoped that the client is experiencing an optimal degree of benefit from the hearing aid concomitant with his/her personal circumstances (degree and type of hearing loss, listening needs, disposable income etc.). Achievement of optimal benefit from a hearing aid fitting is dependent on many factors, not least of which is prescription of appropriate sound signal processing parameters according to which the hearing aid shall operate. Correct prescription of these parameters minimises the need for subsequent fine-tuning adjustments and ensures that such fine-tuning as is necessary proceeds from a meaningful starting point.

It has long been accepted that different users are best served with different choices of sound signal processing in their hearing aids. First and foremost, the user's audiometric data (e.g. absolute threshold of hearing at various frequencies) are often used as input data to a procedure whereby appropriate choices of frequency response and compression parameters are prescribed. The frequency response and the compression parameters prescription usually follow a set of rules named a rationale.

Apart from choice of rationale and the setting thereof the health care person dispensing the hearing aid to the end-user may have to chose a large number of settings within the hearing aid, in order that the user achieves the full benefit of the hearing aid. This could among others be: the range of programs offered to the user, the setting of release and attack time for compression, dynamics of noise damping and directionality shifts, dynamics of program shifts. Also there could be relations between these choices and the chosen rationale for the hearing impaired.

Prior art document WO 2003003792 A1 describes the combination of a given rationale with further parameters, namely the release and attack time constants. According to the document these constants are to be individually chosen, and they are not connected to other parameters of the hearing aid.

In prior art document U.S. Pat. No. 6,175,635 a hearing aid is described whereby external buttons can be linked to various processing schemes in the hearing aid. When the hearing aid according to this document has been programmed and the buttons linked to the preferred processing schemes, the hearing aid is ready for use. However, getting this far is not easy given the number variables to be set. Our invention is a possible solution to this problem.

DESCRIPTION OF THE DRAWING

The present invention will become more fully understood from the detailed description given herein below and the accompanying drawing which is given by way of illustration only, and thus is not limitative of the present invention, and wherein FIG. 1 depicts an embodiment of a system according to the present invention.

The drawing will be described herein.

SUMMARY OF THE INVENTION

Referring to FIG. 1, according to a first aspect of the invention, an equipment for fitting a hearing aid to the specific needs of a hearing impaired individual is provided which comprises a computer 1 or similar device with soft-ware 2, where the device has display means 3 for visual display of data, data entry means 4 for entering hearing aid programming data into the device, data storing means 5, and data output means 6 for outputting programming data to the hearing aid, wherein further means are provided for selecting simultaneous settings 7 relating to two or more different parameters relating to the processing of sound in the hearing aid to be programmed.

In this way the hearing professional working with the hearing aid then gets a limited number of parameters to set, as a number thereof are interlinked and will be set simultaneously. This has the consequence that the different parameters are not settable individually, however it has been discovered that many of the settings relating to especially the dynamic behaviour of the hearing aid are not independent, but can be grouped and set simultaneously.

In an embodiment of the invention the two or more different parameters of the hearing aid to be programmed which are simultaneously selected comprises a rationale and one or more of the following: time constants of the compression, settings relating to vividness of automatic program shifts, settings relating to noise management and settings relating to adaptive directionality.

The invention further concerns software 2 for use in a fitting equipment for fitting a hearing aid. Accordingly the equipment comprising a computer 1 having a display 3, where the software is adapted for controlling parameters of the hearing aid upon control of indicators in the software 7, where the indicators are visible on the display 3, wherein an indicator 8 is provided for simultaneous control of two or more different parameters of the hearing aid.

In an embodiment the parameters which are simultaneously controlled relates to a rationale and one or more of the following: time constants of the compression, settings relating to vividness of automatic program shifts, settings relating to noise management and settings relating to adaptive directionality.

DESCRIPTION OF A PREFERRED EMBODIMENT

In the following the term: "extended rationale" will be used to define a further development of a fitting rationale. An extended rationale covers settings of gain and compression as in usual fitting rationales as well as settings of all automatic features in an instrument, like Noise Management, adaptive directionality, and automatic switching between different modes.

The reason for making extended rationales is that we know that there is not one setting which will be optimal for everyone. Furthermore, there are many more elements in a modern hearing aid that can be adjusted than what we have seen in older instruments, and thereby many more possible combinations. This makes it more difficult to reach an optimal combination, and the risk of making mistakes is significantly larger than what we previously have experienced. Having different extended rationales will give the dispenser the option of changing to another setting that is better for the client rather than just give up on automatic features.

An extended rationale is prescribed for a given program—not for an instrument. Based on audiogram and other data relating to the client, the fitting software will prescribe an extended rationale. Furthermore, it will be possible for the dispenser to change the extended rationale for the client by using an extended rationale selector.

The extended rationales differ from each other in terms of gain, compression time, and parameter values for noise management, adaptive directionality, and automatics. However, settings such as soft squelch and dynamic feedback cancellation are the same across different extended rationales.

An extended rationale will only affect the settings in one program. All extended rationales have the same fitting controls. Extended rationales will initially be prescribed binaurally in a binaural fitting, but different extended rationales for right and left instruments can be selected by the dispenser in a binaural fitting.

An extended rationale selector will provide information about each extended rationale in terms of purpose and a technical description. This text provides guidance to the dispenser on how to select an extended rationale.

Examples of some of the more important settings relating to two different extended rationales, a slow acting and a fast acting extended rationale are given in the table1 1-4 below. As it appears from the tables, when one of the two extended rationales is chosen the whole bunch of parameters are assigned values. This is a great help to the dispenser who do not have to manage a large number of trimmers.

In the following a short description of the most noticeable differences between the two extended rationales is given.

With reference to the four tables below, we can see that many aspects of hearing instrument function are prescribed and controlled differently by the different extended rationales. The extended rationale controls the function of the hearing instrument in order to provide a better match between the wishes of the user and the actual sound processing taking place in the hearing aid and also taking the environment into account.

Table 1 relates to the differences in the amplification strategy of the two extended rationales.

TABLE 1

| | Amplification Strategy | | |
|---|---|---|---|
| | Freq Response | CR max | Compressor Coupling |
| Fast acting ER | +3 dB HF | 3 | −6 |
| Slow acting ER | 0 | 6 | −12 |

Here it can be seen that an increase in high frequency response coupled with limiting the compression by setting the maximum compression range or the "CR Max" to 3 and also keeping a lower degree of compressor coupling will allow the fast acting extended rationale to response to rapid fluctuations in complex environments. Individuals with a lot of demanding listening situations and a high level of cognitive skills will benefit from these settings. Conversely the slow acting extended rationale will provide an amplification strategy with no increase in high frequency response, with more compression and compressor coupling, and this allows for a higher degree of comfort but risk of reduced speech intelligibility in noisy situations.

With respect to dynamics the fast acting and the slow acting extended rationale also differs on a number of points as seen in the table below.

TABLE 2

| | Dynamics | |
|---|---|---|
| | AT | RT |
| Fast acting ER | 20-10 | 80-320 |
| Slow acting ER | 20-10 | 1280 |

A number of different dynamic settings are available when choosing the differences between the fast and slow acting extended rationales. Here the attack and the release times are displayed, and it is noteworthy that both attack times for the slow and fast acting extended rationales are the same, whereas the release times are very different. The attack times should be kept short in all circumstances to ensure proper attenuation of sudden loud sounds like the report from a slamming door. The release times however can be set according to individual preferences. A long release time will ensure little or no pumping effect and good listening comfort. A fast release time decreases listening comfort, but is better when it comes to speech intelligibility especially when the user has well functioning cognitive skills.

Settings relating to automatic noise damping are displayed in table 3 below.

TABLE 3

| | Automatic noisedamping | | |
|---|---|---|---|
| | VF Speed | Max Attenuation | Modulation Sensitivity |
| Fast acting ER | Default | Decreased | Reduced in Noise Only |
| Slow acting ER | Slower | Increased | Default |

Here the parameter "VF Speed" relates to the dynamic behaviour of a voice finder function which plays a role in the automatic noise damping. The VF Speed parameter defines how fast the automatic noise damper function reacts to the onset of voice in the surroundings. The fast acting extended rationale has a faster reaction to the onset of speech than the slow acting. Again the fast acting extended rationale will ensure that a more speech is presented to the user, however the listening comfort is diminished due to more shifts in the sound processing and more noise. The setting of the max Attenuation and the Modulation Sensitivity are also either chosen for best speech intelligibility or for achievement of better comfort in the fast acting or the slow acting extended rationale. Thus the slower acting extended identity will provide more attenuation in the presence of noise and implement a different type of noise management system to provide increased comfort for people who are in less challenging communication environments or do not have the auditory resolution skills to process more complex signals.

Settings relating to automatic directionality are displayed in table 4 below.

TABLE 4

| | Automatic directionality | |
|---|---|---|
| | Fading time | Thresholds |
| Fast acting ER | High | Lower |
| Slow acting ER | Slow | Higher |

The compression strategy and noise management systems are coupled with distinctly different directionality systems. To match the increased speech emphasis and faster compression times, the directionality system in the faster acting extended rationale is designed to activate at a lower sound level and shift between states at a faster rate (Fade time=high). Conversely, the slower extended rationale is designed to give a transparent response to environments (Fade time=slow) and will only change states at higher sound intensity levels. This complements the compression system and noise reduction system in being designed for less challenging communication environments or for people without the auditory processing ability to manage complex processed signals.

The above shown examples are only a small fraction of the multitude of parameters which are set in each extended rationale. Further only two different extended rationales are shown, but in a real hearing aid fitting tool a range of different extended rationale would be available such that individualized fitting is possible. Further a number of the parameters could be made accessible for the dispenser in advanced screen choices, such that if the dispenser wants and has the time, be may adjust individual parameters whenever appropriate.

The invention claimed is:

1. Equipment for fitting a hearing aid to the specific needs of a hearing impaired individual, the equipment comprising:

a computing device that includes software, a display unit, a data intake unit that accepts hearing aid programming data as input, a data storage unit, a hearing aid data output unit that outputs programming data to the hearing aid, and a parameter selector that simultaneously selects and sets values for multiple different parameters relating to the processing of sound in the hearing aid to be programmed based on a single control indicator associated with a particular set of parameter values, wherein said parameters include a rationale, at least one time constant of compression, at least one setting related to vividness of automatic program shifts, at least one setting related to noise management, and at least one setting related to adaptive directionality.

2. The Equipment of claim 1, wherein said parameters can be individually set with alternative or additional control indicators.

3. The Equipment of claim 1, wherein said parameters are grouped into an extended rationale that contains values for each parameter such that said control indicator allows for selection between two or more different extended rationales.

4. The equipment of claim 3, wherein said two or more different extended rationales include a fast-acting extended rationale and a slow-acting extended rationale.

5. The equipment of claim 3, where all available extended rationales contain the same soft squelch and dynamic feedback cancellation settings.

6. A method of fitting a hearing aid, the method comprising:

controlling different parameters of the hearing aid by controlling indicators of said parameters through a computer program that displays said indicators on a display device, said indicators including an indicator for simultaneous control of parameters including: a rationale, at least one time constant of compression, at least one setting related to vividness of automatic program shifts, at least one setting related to noise management, and at least one setting related to adaptive directionality of the hearing aid, where controlling said indicator for simultaneous control includes simultaneously determining and establishing values for all the parameters via the indicator.

7. The method of claim 6, wherein values for said parameters can be individually established with alternative or additional indicators.

8. The method of claim 6, wherein said parameters are grouped into an extended rationale that contains values for each parameter and said indicator for simultaneous control allows for selection between two or more different extended rationales.

9. The method of claim 8, wherein said two or more different extended rationales include a fast-acting extended rationale and a slow-acting extended rationale.

10. The method of claim 8, where all available extended rationales contain the same soft squelch and dynamic feedback cancellation settings.

11. A computer readable medium having embodied thereon a program that, when executed, causes a computing device to carry out a method of fitting a hearing aid, the method comprising:

controlling different parameters of the hearing aid by controlling indicators of said parameters through a computer program that displays said indicators on a display device, said indicators including an indicator for simultaneous control of parameters including: a rationale, at least one time constant of compression, at least one setting related to vividness of automatic program shifts, at least one setting related to noise management, and at least one setting related to adaptive directionality of the hearing aid, where controlling said indicator for simultaneous control includes automatically determining and establishing values for all the parameters when the value of any one particular parameter is set via the indicator.

* * * * *